US007694609B1

(12) United States Patent
Ma

(10) Patent No.: US 7,694,609 B1
(45) Date of Patent: Apr. 13, 2010

(54) LIGHT BULB BASE EXTRACTOR APPARATUS

(76) Inventor: Mark Ma, 1702 W. Thomas St., Hammond, LA (US) 70401

( * ) Notice: Subject to any disclaimer, the term of this patent is extended or adjusted under 35 U.S.C. 154(b) by 0 days.

(21) Appl. No.: 12/061,766

(22) Filed: Apr. 3, 2008

(51) Int. Cl.
*B25B 13/46* (2006.01)

(52) U.S. Cl. ..... 81/53.12

(58) Field of Classification Search ..... 81/53.2, 81/53.11, 53.12, 489, 53.1
See application file for complete search history.

(56) References Cited

U.S. PATENT DOCUMENTS

| | | | | |
|---|---|---|---|---|
| 1,319,028 | A * | 10/1919 | Grinnell | 81/441 |
| 2,117,017 | A * | 5/1938 | Chadsey | 81/53.11 |
| 3,549,188 | A * | 12/1970 | Cerasoli | 81/53.12 |
| 3,797,055 | A * | 3/1974 | Greene | 7/138 |
| 5,042,804 | A * | 8/1991 | Uke et al. | 473/538 |
| 5,103,695 | A | 4/1992 | Dolle et al. | |
| 5,490,438 | A * | 2/1996 | Zupo et al. | 81/53.11 |
| 5,937,714 | A * | 8/1999 | Sherman et al. | 81/53.1 |
| 6,260,442 | B1 | 7/2001 | Bayat | |
| 6,928,901 | B1 * | 8/2005 | Rainin et al. | 81/53.1 |
| 6,976,407 | B1 * | 12/2005 | Desaulniers | 81/53.11 |
| 6,983,675 | B2 * | 1/2006 | Scearce | 81/53.1 |
| 2005/0160879 | A1 * | 7/2005 | Scearce | 81/53.1 |

* cited by examiner

*Primary Examiner*—David B Thomas
(74) *Attorney, Agent, or Firm*—Garvey, Smith, Nehrbass & North, L.L.C.; Gregory C. Smith

(57) ABSTRACT

A hand-held device for extracting a base of a light bulb from a socket, including a body portion, circular in cross-section, and of a diameter which is easily grasped by the human hand; and constructed of rubber or the like material which does not convey electrical current; a rubber jacket over the body portion having protrusions to allow the user to have a firm, non-slip grip on the device when in use; each end being conically shaped end; the first end being of an increasing conical diameter, so as to allow the end to be inserted into a typically sized light bulb base, and the second end being of a slightly less conical diameter to allow the end to be inserted into smaller bulbs, such as Christmas tree or chandelier sized bulbs. Each of the two conical ends would be hollowed out to a certain extent. Further the surface of each conically shaped end would comprise a plurality of parallel ridges which would provide a firmer grip between the device and the bulb base. In use, one end of the device would be inserted into the hollow base of the spent bulb, until the conical surface makes frictional engagement with the interior of the bulb base. At this point, the device is rotated and imparts rotation to the base, which unscrews from the light socket. Even if the power to the fixture is on, the device would not transmit electrical current to the use because of its material makeup.

16 Claims, 3 Drawing Sheets

LIGHT BULB BASE EXTRACTOR APPARATUS

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present invention relates to light bulbs. More particularly, the present invention relates to an apparatus for extracting the base of a light bulb which has exploded or fractured by inserting a portion of the device into the base of the bulk, and rotating the device to unscrew the base from the light bulb socket.

2. General Background

The most common type of light fixture is the type wherein a light bulb, having a metal base, which is treaded into a threaded socket for transmitting the electrical current from the fixture into the bulb to illuminate the bulb. In most cases when the bulb needs to be changed, because of it having expired, the bulk is simply grasped, and rotated, so that it threadedly disengages from the fixture. However, it is quite often the case where the light bulb may have exploded for many reasons, or the bulb portion loses its contact with the base, so that rotating the bulb would not impart rotation to the base. In either case, the problem arises of having to remove the base from the fixture socket, which is somewhat difficult. In some cases, one would attempt to utilize pliers or the like to engage the edge of the metal base and rotate the base out of the socket. This can be sometimes a futile effort, the result being the base crumpled and torn and in some instances, almost impossible to unscrew from the socket because of it being deformed. An additional problem may arise in that if the fixture is still plugged in, one may inadvertently try to remove the base, and in doing so, subject oneself to electrical shock, which is dangerous and painful.

Therefore, there is a need for a device which has the ability to extract the base from a light fixture socket in an easy and safe manner, without deforming the base and without subjecting oneself to electrical shock.

SUMMARY OF THE PRESENT INVENTION

The apparatus of the present invention solves the problems in the art in a simple and straightforward manner. What is provided is a hand-held body portion, circular in cross-section, and of a diameter which is easily grasped by the human hand. The body portion is constructed of rubber or the like material which does not convey electrical current. There could be provided a rubber jacket over the body portion having protrusions to allow the user to have a firm, non-slip grip on the device when in use. Each end of the device would have a conically shaped end, the first end being of an increasing diameter, so as to allow the end to be inserted into a typically sized light bulb base, and the second end being of a slightly less conical diameter to allow the end to be inserted into smaller bulbs, such as Christmas tree or chandelier sized bulbs. Each of the two conical ends would be hollowed out to a certain extent. Further the surface of each conically shaped end would comprise a plurality of parallel ridges which would provide for a firmer grip between the device and the bulb base. In use, one end of the device would be inserted into the hollow base of the spent bulb, until the conical surface makes frictional engagement with the interior of the bulb base. At this point, the device is rotated and imparts rotation to the base, which unscrews from the light socket. Even if the power to the fixture is on, the device would not transmit electrical current to the use because of its material makeup.

Therefore, it is a principal object of the present invention to provide a hand held device to frictionally engage the interior surface of a light bulb base to rotationally extract the base from a light socket.

It is a further object of the present invention to provide a device for extracting the base of a light bulb which has been detached from the base through the use of a conical end portion insertable and frictionally engageable into the base of the bulb to impart rotation to the base when the device is rotated.

It is a further object of the present invention to provide a device for extracting the base of a spent light bulb safely without fear of electrical shock if power is still imparted to the spent light bulb.

It is a further object of the present invention to provide a device for extracting a base of different sized light bulbs, through the use of conically shaped ends of the device insertable into the bulb base.

It is a further object of the present invention to provide a device for extracting a base of a broken light bulb which is able to accommodate an extendor to reach light bulbs in high places.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE PREFERRED EMBODIMENT

Figure 1:
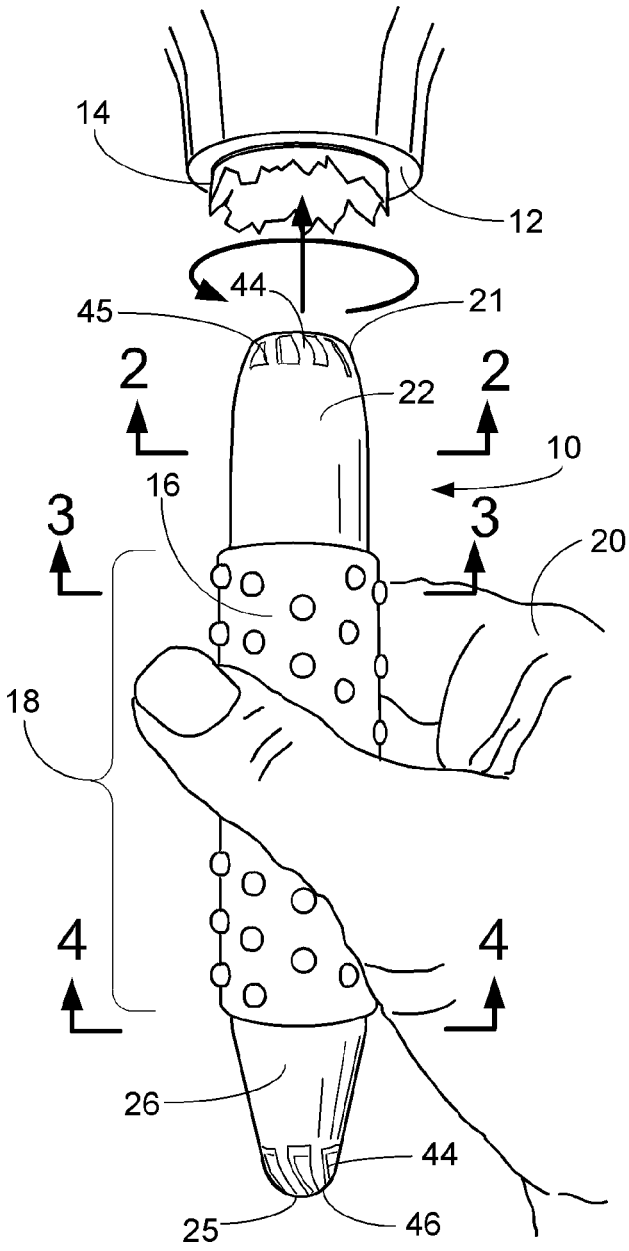
FIG. 1 illustrates an overall view of the apparatus held by a user for engaging the base of a light bulb.
Figure 2:
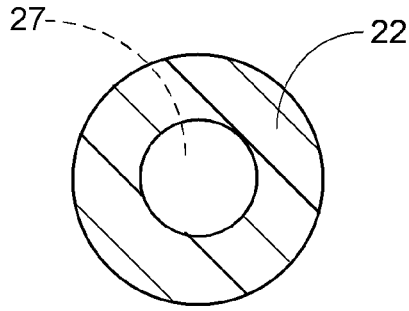
FIG. 2 illustrates the apparatus along lines 2-2 in FIG. 1.

FIGS. 1 through 8 illustrate the preferred embodiment of the apparatus of the present invention by the numeral 10. As illustrated, apparatus 10 is utilized for extracting a base 12 of a broken light bulb from a light fixture socket 14.

Figure 3:
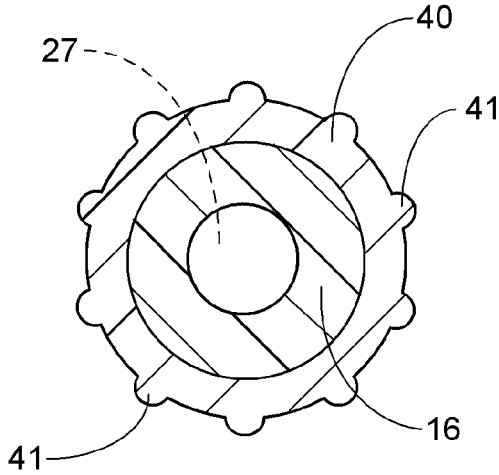
FIG. 3 illustrates the apparatus along lines 3-3 in FIG. 1.
Figure 4:
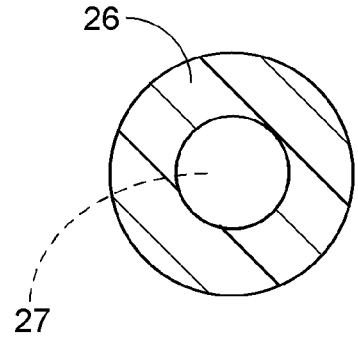
FIG. 4 illustrates the apparatus along lines 4-4 in FIG. 1.

Turning first to the preferred embodiment, as illustrated in FIGS. 1 through 4, the apparatus 10 comprises a body portion 16, circular in cross section, and being of a certain length, depicted by Arrow 18, to be held easily within the grasp of a person's hand 20. There is included a first end 21 of the body portion 16 which terminates in a first cone shaped portion 22, a second end 25 of the body portion 16 which terminates in a second cone shaped portion 26 of a different diameter than the first cone portion 22 of the body portion 16. There is illustrated that the outer surface 32 of the first and second cone end portions 22, 26 provides a surface to frictionally engage a portion 36 of the inner wall 38 of the light bulb base 12, for rotating the base 12 out of engagement with the socket 14, as the apparatus 10 is rotated. Further, as illustrated, each of the conical end portions 22, 26 may include hallowed out portions 27 through their length. As seen in FIG. 3, the hollowed out portions 27 may extend throughout the length of the body portion 16.

Figure 6:
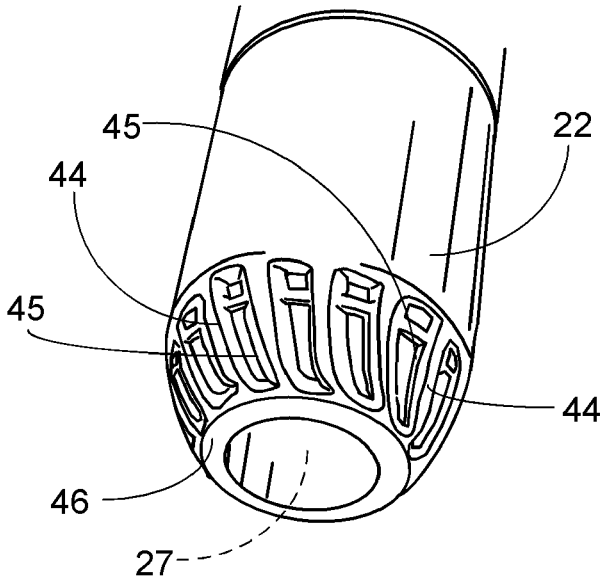
FIG. 6 illustrates a detail view of the end portion of the apparatus of the present invention.

As seen in FIG. 6, there is provided a detailed view the construction of each end portion 22, 26. As illustrated, to enhance the frictional contact between the outer surface 32 of each of the conical end portions 22, 26, there are provided a plurality of parallel ridges 44, defining a series of parallel channels 45 therebetween, on each of the tips 46 of the conical end portions 22, 26 to provide a more secure grip between the device 10 and the bulb base 12.

Figure 5:
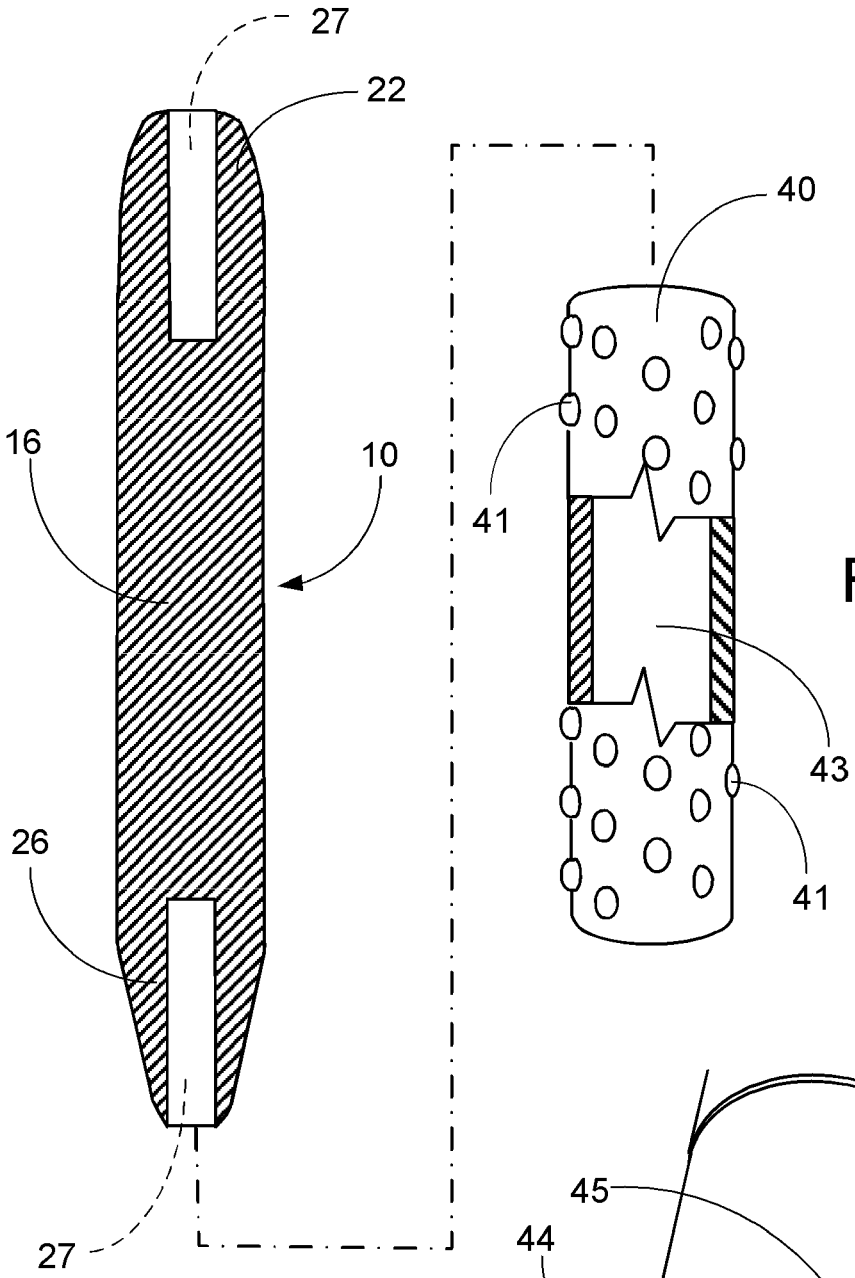
FIG. 5 illustrates an exploded view of the apparatus as illustrated in FIGS. 1 through 4 above.
Figure 7:
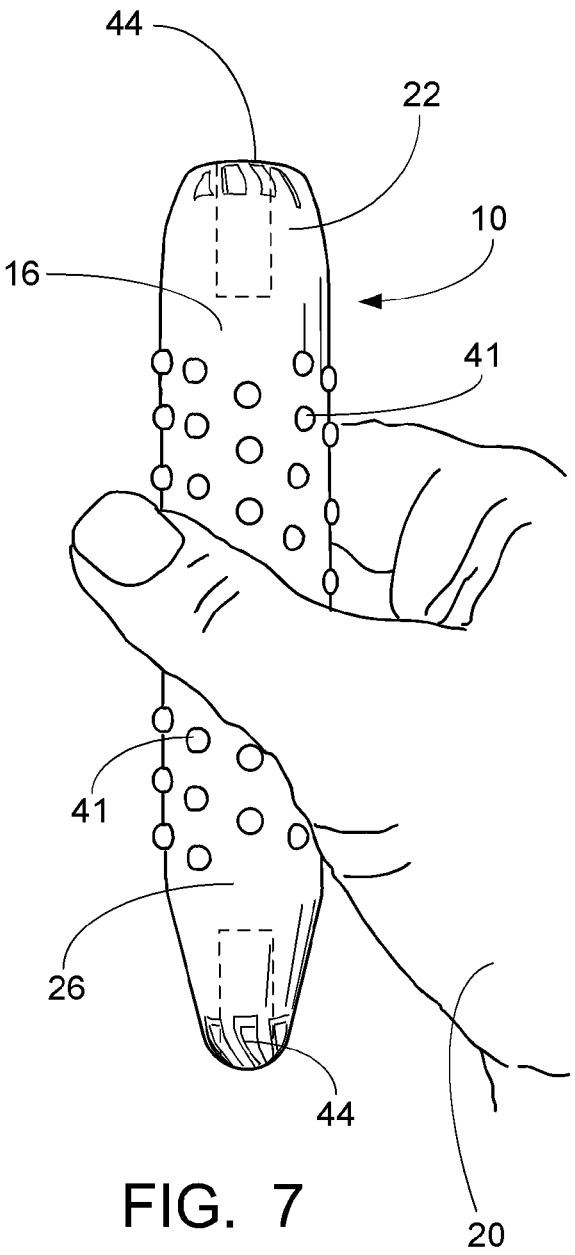
FIG. 7 illustrates an additional embodiment of the present invention.

In the preferred embodiment, the apparatus 10 would be molded from a rubber-like material, selected from a group which would consist of rubber, latex, silicon, soft plastic, or similar material, incapable of transmitting electrical current through the material. This would avoid an electrical shock to the user should any inadvertent contact with the base 12 take place while electrical current is present in the socket 14 of the fixture. As further illustrated, apparatus 10 would further comprise a flexible, removable sleeve 40, which has an opening 43 throughout its length, so as to be slid onto the device 10, as seen in FIG. 5. This sleeve 40 would define a means on the gripable body portion 16 to allow the user to grip the apparatus firmly. Sleeve 40 would be provided with a plurality of protrusions 41 on its surface to enhance the gripability of the device by the user. In FIG. 7 there is provided an embodiment of the device 10 which shows the sleeve 40 being fabricated as part of the body portion 16 as a single unit, so that the sleeve 40 is integral to the body portion 16, and would not be slidable on and off of the body portion 16. The outer surface of body portion 16 would continue to have the protrusions 41 to enhance the grip of the device 10.

Figure 8:
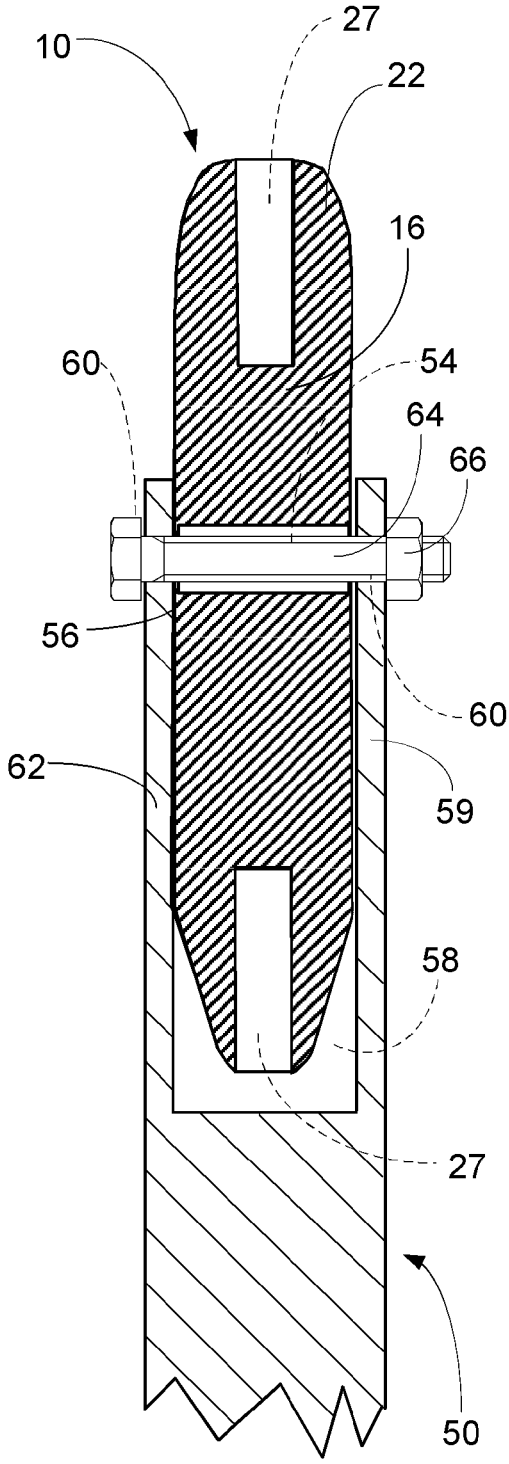
FIG. 8 illustrates a side partial cutaway view of the an embodiment of the apparatus accommodating an extender member thereto.

Turning now to FIG. 8, in the event the user must remove a base 12 from a socket 14, which is in the ceiling and out of reach, there would be further provided a means to engage an extender pole 50 to the device 10 for allowing the user to reach the distant light bulb base 12. There would be provided a transverse bore 54 across and through substantially the midpoint 56 of the body portion 16. The extender pole 50 would have a cylindrical opening 58 at its end 59 into which the body portion 16 is set. The wall portion 62 of the end 59 would have a pair of bores 60 in the wall 62 which would align with the transverse bore 54 in body portion 16. When the bores 60 are aligned with transverse bore 54 in body portion 16, a threaded bolt 64, or the like member, would extend through the bores, and a nut 66 would secure the bolt 64 in place. Therefore, the extender pole 50 could be utilized and rotated by the user, and the device 10 would likewise rotate, being held in place by the bolt 62, until the base 12 is disengaged from the socket.

The following is a list of parts and materials suitable for use in the present invention.

PARTS LIST

| Part Number | Description |
|---|---|
| 10 | apparatus |
| 12 | light bulb base |
| 14 | fixture socket |
| 16 | body portion |
| 18 | arrow |
| 20 | hand |
| 21 | first end portion |
| 22 | first cone shaped portion |
| 25 | second end portion |
| 26 | second cone end portion |
| 27 | hollowed out portions |
| 32 | outer surface |
| 36 | portion |
| 38 | inner wall |
| 40 | removable sleeve |
| 41 | protrusions |
| 44 | parallel ridges |
| 45 | channels |
| 46 | tips |
| 50 | extender pole |
| 54 | transverse bore |
| 56 | midpoint |
| 58 | cylindrical bore |
| 59 | end |
| 60 | bores |
| 62 | wall |
| 64 | bolt |
| 66 | nut |

All measurements disclosed herein are at standard temperature and pressure, at sea level on Earth, unless indicated otherwise.

The foregoing embodiments are presented by way of example only; the scope of the present invention is to be limited only by the following claims.

The invention claimed is:

1. An apparatus for extracting a light bulb base from a light fixture socket, comprising:

a. a body portion to be held in a person's hand;

b. first and second ends of the body portion, each end terminating in a cone shaped portion;

c. the surface of each cone end portion providing a surface to frictionally engage a portion of the inner wall of the light bulb base for rotating the base out of engagement with the socked as the apparatus is rotated; and d. an extender pole, an end of which includes a cylindrical opening into which a portion of the body portion is engaged, so that at either of the cone shaped portions of the body portion can extend from the end of the cylindrical opening in order to engage the base of the light bulb; the body portion held in place with a bolt extending through the wall of the pole and an opening in the body portion, so that when the pole is rotated, the body portion will rotate with the pole to disengage the light bulb base.

2. The apparatus in claim 1, further comprising a second cone shaped end portion of a size different from the first cond shaped end portion to engage different sized light bulb bases.

3. The apparatus in claim 1, wherein the apparatus is molded from a rubber-like material, incapable of transmitting electrical current through the material.

4. The apparatus in claim 1, further comprising a sleeve on the gripable portion to allow the user to grip the apparatus firmly.

5. The apparatus in claim 1, wherein the first and second cone end portions are partially hollowed out members.

6. The apparatus in claim 1, further comprising a plurality of parallel ridges on each of the end portions to provide a more secure grip between the device and the bulb base.

7. An apparatus for extracting a light bulb base from a light fixture socket, comprising:

a. a body portion to be held in a person's hand;

b. a first end of the body portion terminating in a cone shaped portion;

c. a second end of the body portion terminating in a cone shaped portion of a different diameter than the first end of the body portion;

d. the surface of the first and second cone end portions providing a surface to frictionally engage a portion of the inner wall of the light bulb base for rotating the base out of engagement with the socked as the apparatus is rotated; and e. an extender pole, an end of which includes a cylindrical opening into which a portion of the body portion is engaged, so that either the cone shaped end portions of the body portion is capable of extending from the end of the cylindrical opening in order to engage the base of the light bulb; the body portion held in place with a bolt extending through the wall of the pole and an opening in the body portion, so that when the pole is rotated, the body portion will rotate with the pole to disengage the light bulb base.

8. The apparatus in claim 7, wherein the apparatus is molded from a rubber-like material, incapable of transmitting electrical current through the material.

9. The apparatus in claim 7, further comprising a sleeve on the gripable portion to allow the user to grip the apparatus firmly.

10. The apparatus in claim 7, wherein the first and second cone end portions are partially hollowed out members.

11. The apparatus in claim 7, further comprising a plurality of parallel ridges on each of the end portions to provide a more secure grip between the device and the bulb base.

12. An apparatus for extracting a light bulb base from a light fixture socket, comprising:

a. a body portion, having a first and second conical shaped end portions, the apparatus molded from a rubber-like material incapable of transmitting electrical current therethrough, to be held in a person's hand;

b. the surface of the first and second conical end portions providing a surface to frictionally engage a portion of the inner wall of the light bulb base for rotating the base out of engagement with the socked as the apparatus is rotated;

c. the first and second conical end portions having two different diameters for engaging light bulb bases of varying sizes; and d. an extender pole, an end of which includes a cylindrical opening into which a portion of the body portion is engaged, so that at either of the cone shaped end portions of the body portion is capable of extending from the end of the cylindrical opening in order to engage the base of the light bulb; the body portion held in place with a bolt extending through the wall of the pole and an opening in the body portion, so that when the pole is rotated, the body portion will rotate with the pole to disengage the light bulb base.

13. The apparatus in claim 12, wherein an outer surface of the portion of the device gripped by the user comprises a plurality of raised protrusions to enhance gripping the device during use.

14. The apparatus in claim 12, wherein the first and second cone end portions are partially hollowed out members.

15. The apparatus in claim 12, further comprising a plurality of parallel ridges on each of the end portions to provide a more secure grip between the device and the bulb base.

16. The apparatus in claim 12, wherein the rubber-like material is selected from a group consisting of rubber, latex, silicon, soft plastic, or similar material.

* * * * *